US010610720B2

(12) United States Patent
Chen et al.

(10) Patent No.: US 10,610,720 B2
(45) Date of Patent: Apr. 7, 2020

(54) MOUTH-OPENING TRAINING DEVICE HAVING WATER-FILLED BAG

(71) Applicant: Changhua Christian Medical Foundation Changhua Christian Hospital, Changhua (TW)

(72) Inventors: Mu-Kuan Chen, Changhua (TW); Gene Chen, Changhua (TW); Chih-Hua Chen, Changhua (TW); Mei-Hui Chang, Changhua (TW)

(73) Assignee: Changhua Christian Medical Foundation Changhua Christian Hospital, Changhua (TW)

( * ) Notice: Subject to any disclaimer, the term of this patent is extended or adjusted under 35 U.S.C. 154(b) by 889 days.

(21) Appl. No.: 15/253,922

(22) Filed: Sep. 1, 2016

(65) Prior Publication Data

US 2017/0056282 A1 Mar. 2, 2017

(30) Foreign Application Priority Data

Sep. 1, 2015 (TW) ..... 104214166 U

(51) Int. Cl.
*A61H 9/00* (2006.01)
*A61H 1/02* (2006.01)
(Continued)

(52) U.S. Cl.
CPC ..... *A63B 21/008* (2013.01); *A63B 23/032* (2013.01); *A61H 1/02* (2013.01);
(Continued)

(58) Field of Classification Search
CPC . A63B 21/008; A63B 23/032; A63B 21/4035; A63B 21/00065; A63B 21/0004;
(Continued)

(56) References Cited

U.S. PATENT DOCUMENTS 5,562,105 A * 10/1996 Syrop ..... A61C 19/04 128/845
6,361,475 B1 * 3/2002 Jobe ..... A63B 21/0004 482/11

(Continued)

FOREIGN PATENT DOCUMENTS

TW 530654 U 5/2003
TW M426402 U 4/2012

(Continued)

*Primary Examiner* — Quang D Thanh
(74) *Attorney, Agent, or Firm* — Mark M. Friedman

(57) ABSTRACT

A mouth-opening training device includes a water-filled bag having a zigzag edge or a sawtooth edge. By increasing or decreasing the amount of water located inside the water-filled bag to alter the total thickness of the water-filled bag, the device can accommodate different thickness of occlusion of teeth of a patient. The device can make a further improvement on layers of flavor in occlusion of the teeth. The device can further include a plurality of pivotable plate-shaped objects connected or coupled to the water-filled bag. The plate-shaped objects can provide different thickness combinations and further meet the user demands on thickness of occlusion of the teeth.

12 Claims, 4 Drawing Sheets

(51) Int. Cl.
*A63B 21/008* (2006.01)
*A63B 23/03* (2006.01)
*A63B 21/00* (2006.01)

(52) U.S. Cl.
CPC ..... *A61H 2201/1238* (2013.01); *A61H 2201/1261* (2013.01); *A61H 2201/1604* (2013.01); *A61H 2201/1635* (2013.01); *A61H 2201/1664* (2013.01); *A61H 2205/026* (2013.01); *A63B 21/00065* (2013.01); *A63B 21/4035* (2015.10)

(58) Field of Classification Search
CPC ..... A63B 21/00058; A63B 21/00069; A63B 21/00072; A63B 21/00076; A63B 21/00178; A63B 21/00181; A63B 21/00185; A63B 21/002; A63B 21/0023; A63B 21/0084; A63B 21/0085; A63B 21/0088; A63B 21/02; A63B 21/028; A63B 21/05; A63B 21/0601; A63B 21/0602; A63B 21/08; A63B 21/15; A63B 21/159; A63B 21/4023; A63B 21/4025; A63B 21/4027; A63B 23/025; A63B 23/03; A63B 69/0057; A63B 69/0059; A63B 71/0054; A63B 71/08; A63B 71/081; A63B 71/085; A63B 71/2071; A63B 71/086; A63B 71/088; A63B 2071/00063; A63B 2071/0072; A61H 1/02; A61H 2201/1635; A61H 2201/1604; A61H 2201/1261; A61H 2205/026; A61H 2201/1664; A61H 2201/1238
See application file for complete search history.

(56) References Cited

U.S. PATENT DOCUMENTS

| | | | | |
|---|---|---|---|---|
| 8,376,912 | B1 * | 2/2013 | Dedvukaj | A63B 23/032 482/11 |
| 2011/0146672 | A1 * | 6/2011 | Schmal | A61M 16/0493 128/200.24 |
| 2012/0172677 | A1 * | 7/2012 | Logan | A61B 5/082 600/301 |
| 2014/0018710 | A1 * | 1/2014 | Israel | A61H 1/02 601/5 |

FOREIGN PATENT DOCUMENTS

| | | |
|---|---|---|
| TW | M455497 U | 6/2013 |
| TW | M484402 U | 8/2014 |

* cited by examiner

MOUTH-OPENING TRAINING DEVICE HAVING WATER-FILLED BAG

TECHNICAL FIELD OF THE DISCLOSURE

The present invention relates to an apparatus for rehabilitation, and more particularly, to a mouth-opening training device.

BACKGROUND OF THE DISCLOSURE

Patients with oral cancer often need the cancer to be excised in order to save their lives. With people that chew betel quid leading to oral disease, oral cancer post operation, head and neck disease after radiotherapy, and special oral diseases may be unable to carry out normal opening and closing of the jaw. This seriously affects daily life and dietary intake of the patients. Therefore, persistent mouth-opening training is quite necessary during therapy. The mouth-opening training can also slow down fibrosis of muscles and development of joints stiffened. In addition, it may be necessary for the patients with other craniofacial diseases to do mouth opening and closing exercises. For example, congenital disorder of temporomandibular joint and injury of oral or craniofacial parts are common craniofacial diseases. A good mouth-opening training device is very important for these types of patients.

A mechanical rehabilitation tool for carrying out mouth opening and closing exercises, disclosed in Taiwan Patent No. M426402, has a first body and a second body, of which the tails are extending to form a first trapezoidal platform and a second trapezoidal platform, respectively. The first body and the second body are pivotably connected and are engaged with a screw thread adjusting rod. The rotation of the screw thread adjusting rod is transformed into relative displacement of the first body and the second body along axial direction, thereby moving the second trapezoidal platform toward or away from the first trapezoidal platform. In this way, the opening or closing state for the first and second trapezoidal platforms are controllable. However, this mechanical rehabilitation tool can only carry out the job of sustaining the upper and lower jaws and only has a one-way stretching ability without an elastic recovery function, therefore it is not effective to make the mouth open and close using this tool such that a slow improvement may be yield in rehabilitation. Also, this mechanical rehabilitation tool consists of many components with relatively complicated manufacturing, so the cost is high. Because of its high cost, it is a problem for patients with little money.

A mouth exercise device disclosed in Taiwan Patent No. M455497 includes a plate supporting body and a handle. The plate supporting body has an upper plate supporting portion and a lower plate supporting portion, which are connected to each other to form a ring-like body, such that an accommodating space is formed inside the plate supporting body. The handle is fastened to the plate supporting body. The accommodating space has a plurality of strengthening ribs disposed therein. Each strengthening rib has two ends which are respectively fastened to the upper plate supporting portion and the lower plate supporting portion. The strengthening ribs can support the plate supporting body and increase elastic strength in occlusion of teeth of a patient. An oral rehabilitation tool disclosed in Taiwan Patent No. 530654 has a long plate-shaped supporting body made of a material with great toughness, and more than one stress resisting elements which are plate-shaped bodies made of a rigid material such as wood, hard plastic, and metal. The plate-shaped supporting body has an accommodating portion penetrating the left and right sides thereof for accommodating the stress resisting elements. When the mouth of a patient can be opened to a certain degree, one or more stress resisting elements can be placed into the accommodating portion of the plate-shaped supporting body for increasing the cross-sectional area of the plate-shaped supporting body so as to expand an angle of an opened mouth of the patient.

An inflatable mouth opener disclosed in Taiwan Patent No. M484402 has a supporting member and an inflatable sack like device. The supporting member is an elastic member made by bending a metal plate. The supporting member has a curved end and two opposite ends. Both of the two opposite ends are perforated to form fastening holes. The inflatable sack like device is made of an elastic material, and its surface is protruded to form two engaging members and are stuck respectively into the fastening holes. In this way, the inflatable sack like device is fastened between the two opposite ends. By filling the air into or withdrawing the air from the inflatable sack like device, the spacing between the two opposite ends can be expanded or recovered again. In this way, it can be easily to insert the mouth opener between the teeth of a patient from the curved end and then fill the air into the inflatable sack like device so as to open the patient's mouth with help of air pressure for being convenient for subsequent medical treatments.

Among the above-described conventional devices, some of them use elastic or rigid supporting solid objects to adapt to or change the thickness of occlusion of the teeth of a patient while one of them utilizes air pressure to open the patient's mouth. Regardless of an elastic supporting solid object or an inflatable sack like device, a certain degree of elastic support is provided in occlusion of the teeth of the patient and the used materials also provide a certain degree of comfort for the patient. However, an improvement on layers of flavor in occlusion of the teeth of the patient is unlikely to be carried out using the conventional devices, and a patient's further demands may not be satisfied. The elasticity of the conventional supporting objects is within a certain range, and a changeless feeling is easily occurred to a patient doing the mouth opening and closing exercises. Further, the inflatable sack like device has an issue that the recovery force is hard to be controlled. Also, the inflatable mouth opener disclosed in TW M484402 is utilized to open the patient's mouth for subsequent medical treatments but is not utilized for rehabilitation of a patient's mouth opening and closing motions.

Accordingly, how to improve the above-described conventional mouth opener and solve the problems described above are important issues in related technical fields.

SUMMARY OF THE DISCLOSURE

The objective of the present invention is to provide a mouth-opening training device for improving the ability of mouth opening and closing of a patient.

To achieve the objective above, the present invention provides a mouth-opening training device, comprising: a water-filled bag having an accommodating space configured to accommodate water, the water-filled bag being perforated to form an opening on a surface thereof, the water being injected into or withdrawn from the accommodating space of the water-filled bag via the opening; the water-filled bag comprising lateral sides having folds, and top and bottom sides relative to the folding lateral sides, the top and bottom sides being provided for occlusion of upper and lower teeth of a patient; the spacing between the top and bottom sides of the water-filled bag and the total thickness of the water-filled bag being adjusted by increasing or decreasing the amount of water located inside the water-filled bag so as to accommodate different thickness of occlusion of the teeth.

In another aspect, the present invention provides a mouth-opening training device, comprising: a water-filled bag having an accommodating space configured to accommodate water, the water-filled led bag being perforated to form an opening on a surface thereof, the water being injected into or withdrawn from the accommodating space of the water-filled bag via the opening; the water-filled bag comprising lateral sides having folds, and top and bottom sides relative to the folding lateral sides, the top and bottom sides being provided for occlusion of upper and lower teeth of a patient; the spacing between the top and bottom sides of the water-filled bag and the total thickness of the water-filled bag being adjusted by increasing or decreasing the amount of water located inside the water-filled bag so as to accommodate different thickness of occlusion of the teeth; and a plurality of plate-shaped objects of different thickness, coupling to the water-filled bag at the same side and being pivotably connected to each other at the same side with a rivet such that the plate-shaped objects are able to be overlapped one above another as well as separated from each other.

In still another aspect, the present invention provides a mouth-opening training device, comprising: a water-filled bag having an accommodating space configured to accommodate water, the water-filled bag being perforated to form an opening on a surface thereof, the water being injected into or withdrawn from the accommodating space of the water-filled bag via the opening; the water-filled bag comprising a pipe and a connector, the pipe being attached to the opening at one end thereof and being connected to the connector at the other end thereof, the connector being adapted to a syringe; the water-filled bag further comprising lateral sides having folds, and top and bottom sides relative to the folding lateral sides, the top and bottom sides being provided for occlusion of upper and lower teeth of a patient; when the water is injected into the water-filled bag, the water in the water-filled bag pushing the folding lateral sides of the water-filled bag such that the spacing between the folds on the lateral sides is increased, and thus the thickness of the water-filled bag is increased; when the water is withdrawn from the water-filled bag, the spacing between the folds on the lateral sides is decreased, and thus the total thickness of the water-filled bag is decreased; and a plurality of plate-shaped objects of different thickness, coupling to the water-filled bag at the same side and being pivotably connected to each other at the same side such that the plate-shaped objects are able to be overlapped one above another as well as separated from each other.

In the present invention, the mouth-opening training device includes a water-filled bag having a zigzag edge or a sawtooth edge. By increasing or decreasing the amount of water located inside the water-filled bag to alter the total thickness of the water-filled bag, the mouth-opening training device can accommodate different thickness of occlusion of teeth of a patient. Not only that, the mouth-opening training device can not only provide a certain degree of comfort and flexibility in occlusion of the teeth, but also make a further improvement on layers of flavor in occlusion of the teeth to meet a user's further demands with use of the variety of change and the tenderness of water in the water-filled bag when a patient does the mouth opening and closing exercises. The mouth-opening training device can further include a plurality of pivotable plate-shaped objects connected or coupled to the water-filled bag. The plate-shaped objects can provide different thickness combinations and further meet the user demands on thickness of occlusion of the teeth.

DETAILED DESCRIPTION OF THE DISCLOSURE

To make the objectives, technical schemes, and effects of the present invention more clear and definite, the present invention is described in further detail below with reference to the embodiments in accompanying with the appending drawings. It should be understood that the specific embodiments described herein are merely for explaining the present invention, and as used herein, the term "embodiment" refers to an instance, an example, or an illustration but is not intended to limit the present invention. In addition, in the appending drawings, the components having similar or the same structures or functions are indicated by the same reference number.

Figure 1:
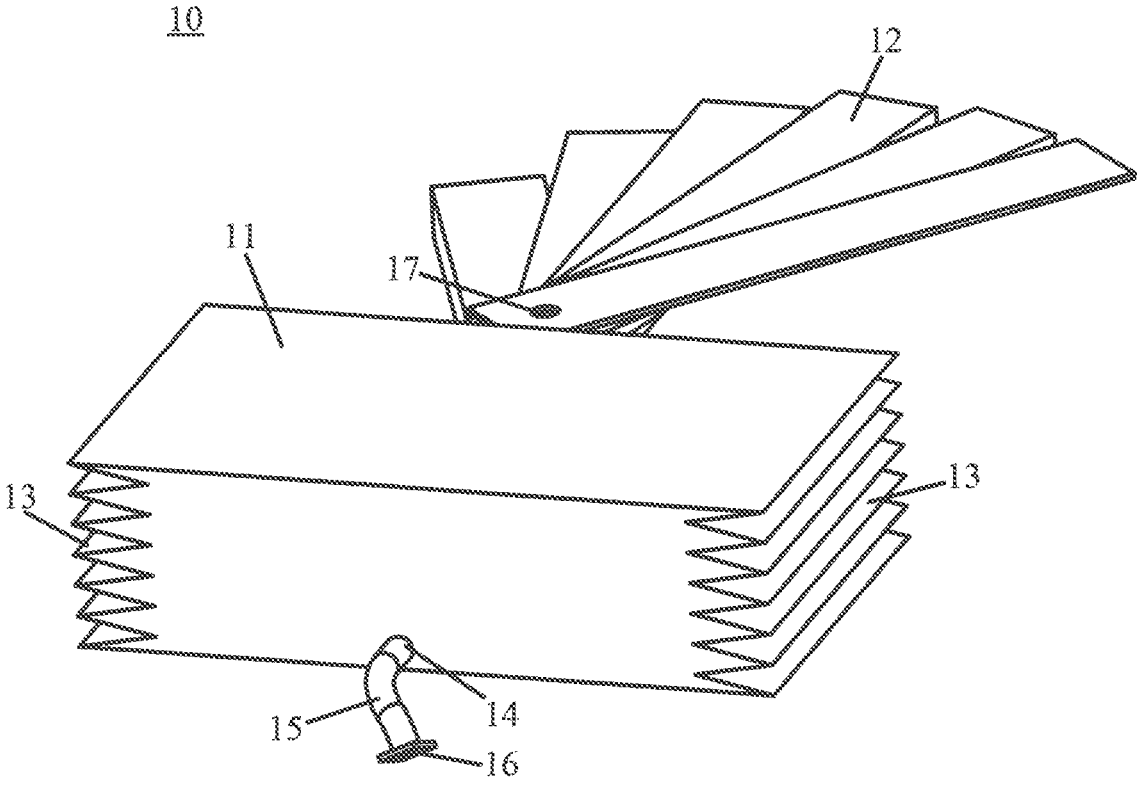
FIG. 1 is a schematic diagram showing a mouth-opening training device in accordance with the present invention.

Please refer to FIG. 1, which is a schematic diagram showing a mouth-opening training device 10 in accordance with the present invention. The mouth-opening training device 10 of the present invention includes two major parts in structure. The first part directs to a water-filled bag 11 having folding lateral sides while the second part directs to a configuration of a plurality of plate-shaped objects 12, which are of different thickness. The plate-shaped objects 12 are coupled to the water-filled bag 11 at the same side and specifically, a rod (not shown) may be adopted to carry out the coupling. The rod is connected to the water-filled bag 11 at one end thereof and is connected to the plural plate-shaped objects 12 at the other end thereof. Each individual one of the aforesaid first and second parts can carry out mouth-opening training, that is, a patient can use the first part and the second part separately to do mouth opening and closing exercises.

The water-filled bag 11 is a bag, pocket, or sack like object, of which the inner space can be used to accommodate water. The lateral sides of the water-filled bag 11 have folds and specifically, the folding lateral sides of the water-filled bag 11 have a zigzag edge or a sawtooth edge, for example. The water-filled bag 11 is perforated to form an opening 14 on a surface thereof. Thus, the water can be injected into or withdrawn from the water-filled bag 11 via the opening 14. The opening 14 can be connected to a pipe 15, which may have a connector 16 at the other end thereof. The connector 16 is adapted to a common-used medical syringe or needle. It is convenient to use a syringe or needle to inject the water or withdrawn the same. Basically, the water-filled bag 11 can be made in any appropriate form. FIG. 1 is illustrated with a cuboid bag, but various shapes or alterations would be applicable as well.

Figure 2:
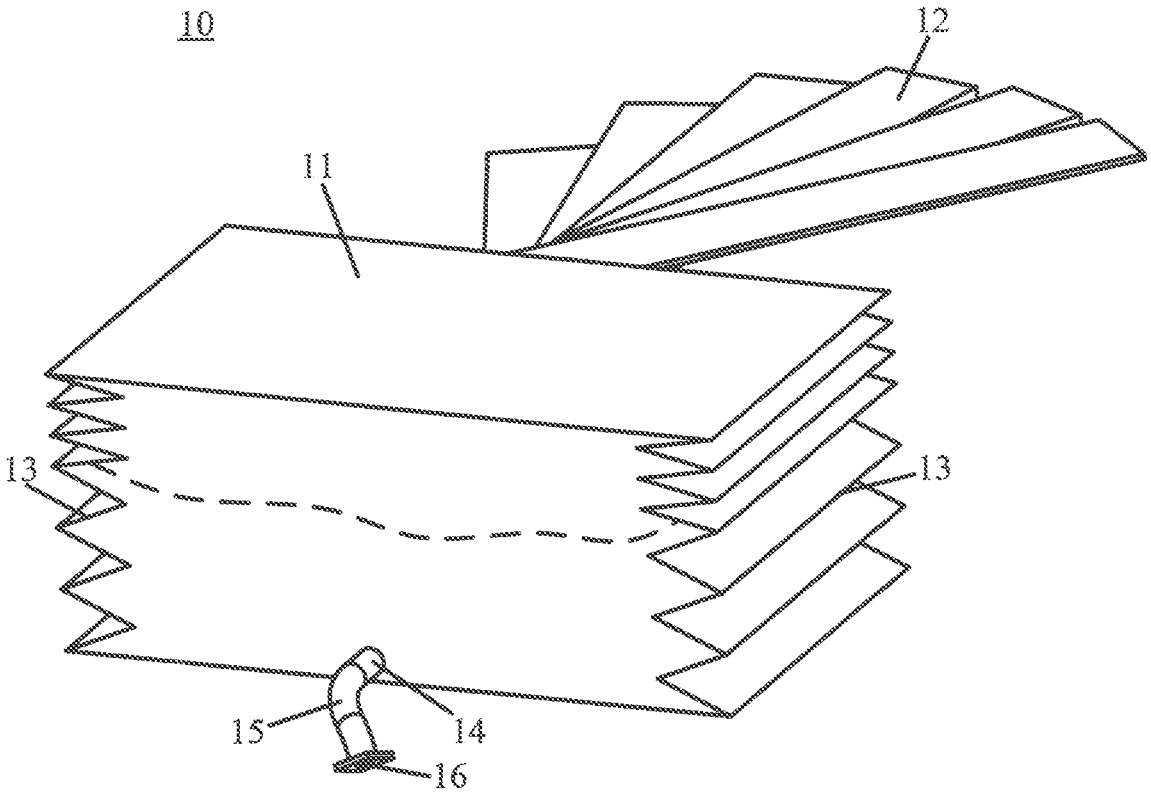
FIG. 2 is a schematic diagram showing the mouth-opening training device of FIG. 1 having water injected into a water-filled bag thereof.

The folds on the zigzag edge or the sawtooth edge 13 of the water-filled bag 11 are arranged along a straight line and are substantially perpendicular to the top and bottom surfaces of the water-filled bag 11. When the water is injected into the water-filled bag 11, the water in the water-filled bag 11 pushes the lateral sides of the water-filled bag 11 such that the spacing between the folds on the sawtooth edge is increased, thereby increasing the total thickness of the water-filled bag 11, that is, the distance between the top and bottom surfaces of the water-filled bag 11 is increased, as shown in FIG. 2. Similarly, when the water is withdrawn from the water-filled bag 11, the spacing between the folds on the sawtooth edge is decreased, thereby decreasing the total thickness of the water-filled bag 11, that is, the distance between the top and bottom surfaces of the water-filled bag 11 is decreased. The top and bottom sides of the water-filled bag 11 is provided for occlusion of upper and lower teeth of a patient. Therefore, the patient can increase or decrease the amount of water located inside the water-filled bag 11 to carry out adjusting the total thickness of the water-filled bag 11 in order to accommodate different thickness of occlusion of the teeth.

The aforesaid plural plate-shaped objects 12 are pivotably connected to each other at the same side with a rivet such that the plate-shaped objects 12 are able to be overlapped one above another as well as separated from each other. The plate-shaped objects 12 can serve as a handle when all of them are overlapped. The handle is provided for a patient to grip it in using the water-filled bag 11. Depending on the demand on thickness of occlusion of the teeth, the patient can select appropriate ones of the plate-shaped objects 12 and overlap the selected ones. The thickness of the plate-shaped objects 12 is different from each other. For instance, the plate-shaped objects 12 respectively are 1 mm, 2 mm, 4 mm, 6 mm, 8 mm, and 10 mm in thickness. For example, a 3 mm-thickness result can be obtained by overlapping two plate-shaped objects 12 respectively of 1 mm and 2 mm thickness. The patient can carry out various thickness combinations as desired. Of course, the thickness of the plate-shaped objects 12 can be designed in another way. Therefore, the present invention can meet various user demands on different thickness of occlusion of the teeth by overlapping different plate-shaped objects 12 to alter the resulted thickness.

Figure 3:
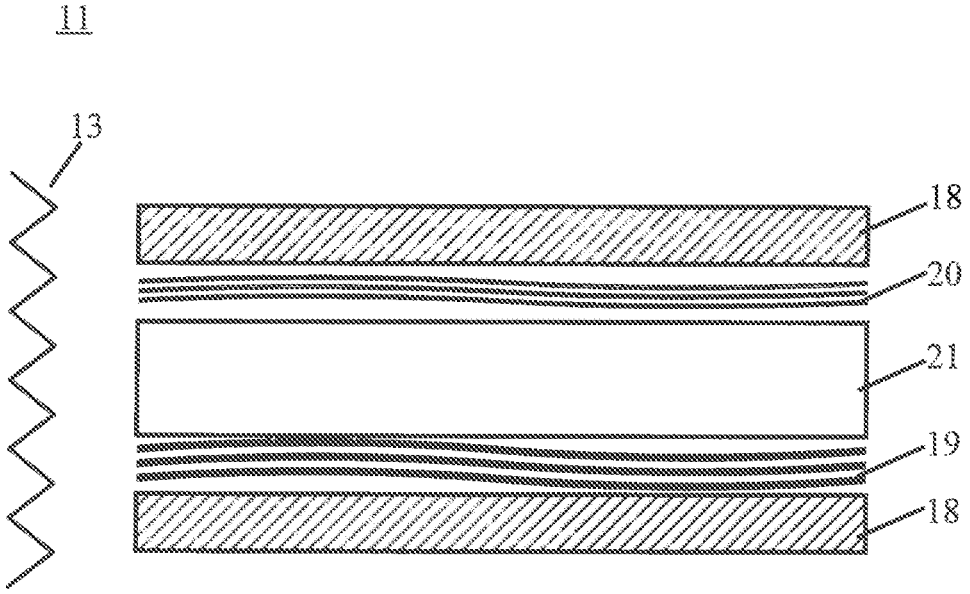
FIG. 3 is a schematic diagram showing the materials used in the water-filled bag in accordance with the present invention.

FIG. 3 is a schematic diagram showing the materials used in the water-filled bag 11 in accordance with the present invention. The outermost layers (at least on the top and bottom sides) of the water-filled bag 11 are made of a silicone material 18. Regarding health concern, it is preferred to adopt food-grade or medical-grade silicone as the silicone material 18. A hard material 19 is disposed therebetween a lower-side silicone material 18 and an inner accommodating space 21 of the water-filled bag 11 for providing support in a certain degree. A little less hard material 20 is disposed between an upper-side silicone material 18 and the inner accommodating space 21 of the water-filled bag 11. The hardness of the little less hard material 20 is less than that of the hard material 19. An elastic hard material may be selected as the material of the sawtooth edge 13, which can provide a certain degree of support for the patient in occlusion of the teeth at the water-filled bag 11. It can provide an excellent comfortable experience in occlusion of the teeth without drawbacks of being too soft.

Figure 4:
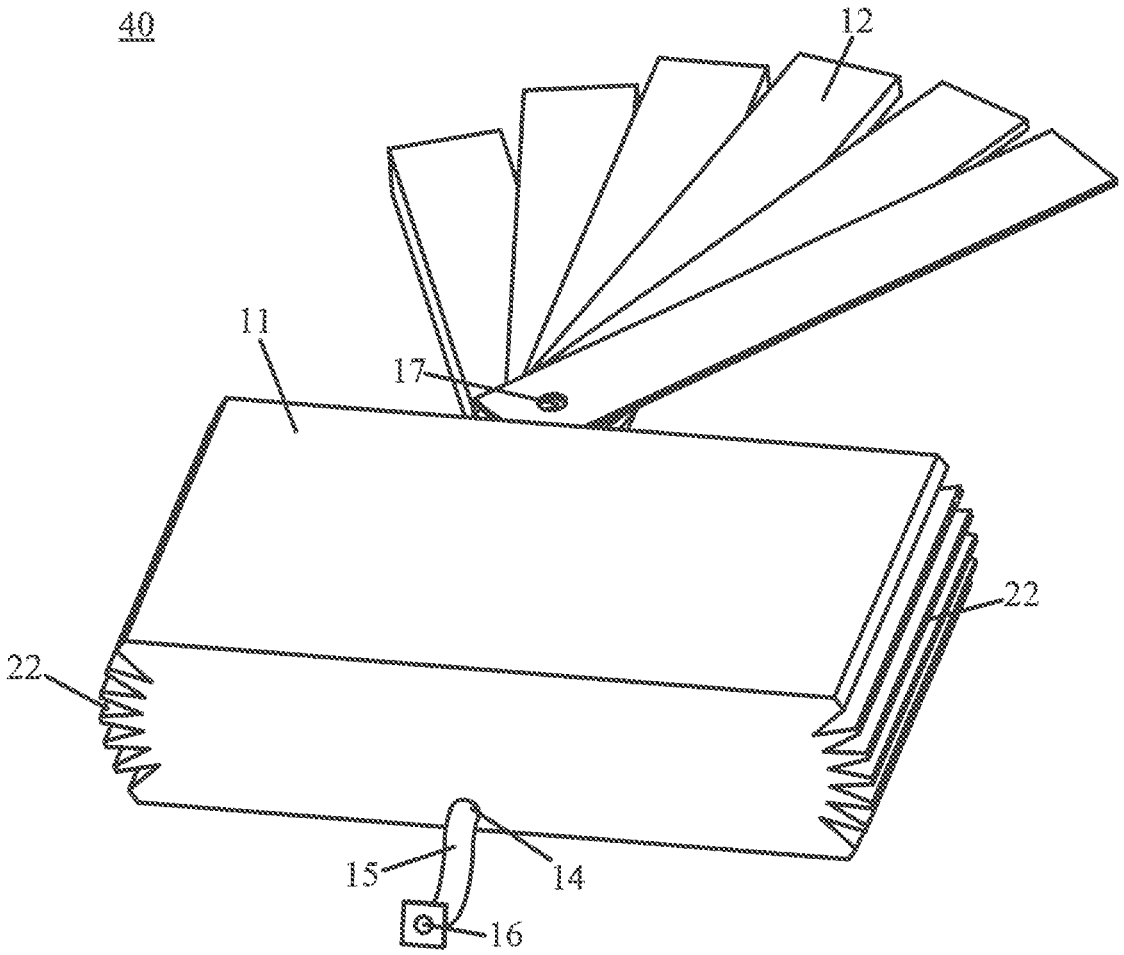
FIG. 4 is a schematic diagram showing a mouth-opening training device in accordance with an embodiment of the present invention.

FIG. 4 is a schematic diagram showing a mouth-opening training device 40 in accordance with an embodiment of the present invention. The difference between the mouth-opening training device 40 shown in FIG. 4 and the mouth-opening training device 10 shown in FIG. 1 is that the folds on the zigzag edge or the sawtooth edge 22 of the mouth-opening training device 40 are arranged along a curved line. In comparison to the device 10 shown in FIG. 1, the structure of the device 40 shown in FIG. 4 provides different strength of response to the occlusion of the teeth of the patient, and various user demands may thus be satisfied.

In the present invention, the mouth-opening training devices 10 and 40 include the water-filled bag 11 having the zigzag edge or the sawtooth edge 13. By increasing or decreasing the amount of water located inside the water-filled bag 11 to alter the total thickness of the water-filled bag 11, the mouth-opening training devices 10 and 40 can accommodate different thickness of occlusion of teeth of a patient. Not only that, the mouth-opening training devices 10 and 40 can not only provide a certain degree of comfort and flexibility in occlusion of the teeth, but also make a further improvement on layers of flavor in occlusion of the teeth to meet a user's further demands with use of the variety of change and the tenderness of water in the water-filled bag 11 when a patient does the mouth opening and closing exercises. The mouth-opening training devices 10 and 40 can further include a plurality of pivotable plate-shaped objects 12 connected or coupled to the water-filled bag 11. The plate-shaped objects 12 can provide different thickness combinations and further meet the user demands on thickness of occlusion of the teeth.

While the preferred embodiments of the present invention have been illustrated and described in detail, various modifications and alterations can be made. The embodiment of the present invention is therefore described in an illustrative but not restrictive sense. It is intended that the present invention should not be limited to the particular forms as illustrated, and that all modifications and alterations which maintain the spirit and realm of the present invention are within the scope as defined in the appended claims.

What is claimed is:

1. A mouth-opening training device, comprising:

a water-filled bag having an accommodating space configured to accommodate water, the water-filled bag being perforated to form an opening on a surface of the water-filled bag, the water being injected into or withdrawn from the accommodating space of the water-filled bag via the opening; the water-filled bag comprising lateral sides having folds, and top and bottom sides relative to the lateral sides, the top and bottom sides being provided for occlusion of upper and lower teeth of a patient; spacing between the top and bottom sides of the water-filled bag and total thickness of the water-filled bag being adjusted by increasing or decreasing an amount of water located inside the water-filled bag so as to accommodate different thickness of occlusion of the upper and lower teeth of the patient; and a plurality of plate-shaped objects of different thickness, coupling to the water-filled bag at a same side of the plate-shaped objects and being pivotably connected to each other at the same side of the plate-shaped objects with a rivet such that the plate-shaped objects are able to be overlapped one above another as well as separated from each other.

2. The mouth-opening training device according to claim 1, wherein when the water is injected into the water-filled bag, the water in the water-filled bag pushes the lateral sides of the water-filled bag such that the spacing between the folds on the lateral sides is increased, and thus the total thickness of the water-filled bag is increased; when the water is withdrawn from the water-filled bag, the spacing between the folds on the lateral sides is decreased, and thus the total thickness of the water-filled bag is decreased.

3. The mouth-opening training device according to claim 1, wherein outermost layers on the top and bottom sides of the water-filled bag are made of a silicone material, a lower-side silicone material of the silicone material and the accommodating space of the water-filled bag have a first hard material disposed therebetween, an upper-side silicone material of the silicone material and the accommodating space of the water-filled bag have a second hard material disposed therebetween, and hardness of the second hard material is less than that of the first hard material.

4. The mouth-opening training device according to claim 1, wherein the lateral sides of the water-filled bag comprise a zigzag edge or a sawtooth edge.

5. The mouth-opening training device according to claim 4, wherein the folds on the lateral sides of the water-filled bag are located on the zigzag edge or the sawtooth edge, and the folds on the zigzag edge or the sawtooth edge are arranged along a straight line and are perpendicular to top and bottom surfaces of the water-filled bag.

6. The mouth-opening training device according to claim 4, wherein the folds on the lateral sides of the water-filled bag are located on the zigzag edge or the sawtooth edge, and the folds on the zigzag edge or the sawtooth edge are arranged along a curved line.

7. The mouth-opening training device according to claim 1, wherein the water-filled bag further comprises a pipe and a connector, the pipe is attached to the opening at one end of the pipe and is connected to the connector at another end of the pipe.

8. A mouth-opening training device, comprising:

a water-filled bag having an accommodating space configured to accommodate water, the water-filled bag being perforated to form an opening on a surface of the water-filled bag, the water being injected into or withdrawn from the accommodating space of the water-filled bag via the opening; the water-filled bag comprising a pipe and a connector, the pipe being attached to the opening at one end of the pipe and being connected to the connector at another end of the pipe; the water-filled bag further comprising lateral sides having folds, and top and bottom sides relative to the lateral sides, the top and bottom sides being provided for occlusion of upper and lower teeth of a patient; when the water is injected into the water-filled bag, the water in the water-filled bag pushing the lateral sides of the water-filled bag such that spacing between the folds on the lateral sides is increased, and thus total thickness of the water-filled bag is increased; when the water is withdrawn from the water-filled bag, the spacing between the folds on the lateral sides is decreased, and thus the total thickness of the water-filled bag is decreased; and a plurality of plate-shaped objects of different thickness, coupling to the water-filled bag at a same side of the plate-shaped objects and being pivotably connected to each other at the same side of the plate-shaped objects such that the plate-shaped objects are able to be overlapped one above another as well as separated from each other.

9. The mouth-opening training device according to claim 8, wherein outermost layers on the top and bottom sides of the water-filled bag are made of a silicone material, a lower-side silicone material of the silicone material and the accommodating space of the water-filled bag have a first hard material disposed therebetween, an upper-side silicone material of the silicone material and the accommodating space of the water-filled bag have a second hard material disposed therebetween, and hardness of the second hard material is less than that of the first hard material.

10. The mouth-opening training device according to claim 8, wherein the lateral sides of the water-filled bag comprise a zigzag edge or a sawtooth edge.

11. The mouth-opening training device according to claim 10, wherein the folds on the lateral sides of the water-filled bag are located on the zigzag edge or the sawtooth edge, and the folds on the zigzag edge or the sawtooth edge are arranged along a straight line and are perpendicular to top and bottom surfaces of the water-filled bag.

12. The mouth-opening training device according to claim 10, wherein the folds on the lateral sides of the water-filled bag are located on the zigzag edge or the sawtooth edge, and the folds on the zigzag edge or the sawtooth edge are arranged along a curved line.

* * * * *